United States Patent [19]

Gendron et al.

[11] 4,138,199

[45] Feb. 6, 1979

[54] METHOD OF DRIVING PILES UNDERWATER

[75] Inventors: George J. Gendron, Houston; Lindsey J. Phares, Sugarland, both of Tex.

[73] Assignee: Raymond International, Inc., Houston, Tex.

[21] Appl. No.: 743,227

[22] Filed: Nov. 19, 1976

[51] Int. Cl.[2] ..... E02D 5/74

[52] U.S. Cl. ..... 405/232; 405/208

[58] Field of Search ..... 61/53.5, 94, 95, 98, 61/99, 89

[56] References Cited

U.S. PATENT DOCUMENTS

| | | | |
|---|---|---|---|
| 3,502,159 | 3/1970 | Pogonowski | 61/53.5 |
| 3,815,371 | 6/1974 | Koehler | 61/94 |
| 4,033,139 | 7/1977 | Frederick | 61/53.5 |

*Primary Examiner*—Jacob Shapiro

*Attorney, Agent, or Firm*—Arnold, White & Durkee

[57] ABSTRACT

A method is disclosed for driving a pile into the ocean floor utilizing an underwater hammer. A leg of an offshore jacket structure is provided with several annular guide sleeves affixed to the leg at several spaced apart locations along the exterior of the leg. A pile is disposed underwater in the lower guide sleeves proximate the lower end of the structure leg. A housing assembly having a hammer mounted inside is lowered from the surface through the guide sleeves and into contact with the top of the pile, with the hammer being beneath the surface. The pile is driven by a succession of blows delivered by the hammer. The housing is then raised to the surface and moved to another driving location by an overhead sling.

11 Claims, 13 Drawing Figures

26
46
48
52
44
38
28
38
38
40

26
44
48
46
38
28
38
38

26
20
42
36
36
36
36
34
32
30
44
46
48
38
28
38
38
40
38
50
24
22

METHOD OF DRIVING PILES UNDERWATER

IDENTIFICATION OF RELATED APPLICATIONS

This application is related in subject matter to copending U.S. patent application Ser. No. 743,327, entitled "Pile Driving System" filed on even date herewith in the names of H. A. Nelson Holland and George J. Gendron and commonly assigned with this application.

BACKGROUND OF THE INVENTION

1. Field of the Invention

The present invention relates to a method of driving piles into the ocean floor utilizing a pile-driving hammer; and more particularly, the present invention relates to a method of driving piles in great depths of water using an underwater pile-driving hammer.

2. Description of the Prior Art

In the installation of an offshore structure, or jacket structure, such as a drilling or production platform, it is the general practice to secure the structure in some manner to the ocean floor to prevent overturning of the structure. A conventional technique for securing the offshore structure to the ocean floor is the driving of elongated piles into the ocean floor. Typically, an offshore structure will have several legs to support the structure, with one or more piles being provided at each leg depending upon the type of soil into which the piles are to be driven. Generally, piles will be carried in pile sleeves attached to the outside of the support legs during onshore fabrication of the structure.

Driving of the piles has typically been done by a compressed air or steam hammer that delivers repetitive blows to the top of a pile. In most cases, and particularly when great depths of water are involved, it is necessary to employ a pile follower. A pile follower is an extension that contacts the top of the pile and is struck by the pile hammer. Followers have several disadvantages; they are of extremely heavy weight and are expensive. Greater inefficiency is introduced in the pile driving system due to the believed energy loss in transmitting a blow through the follower to the upper end of the pile. Also, followers are often joined in sections with joints which can fail and require repairs that are both costly and difficult to make. The disadvantages of followers are most acute when it is necessary to drive a pile in a deep body of water. In such a case, it is believed necessary to employ an extremely large pile driving hammer to overcome the energy loss through the follower sections, and a derrick barge must be provided to handle the great weight and length of the follower.

Depending on the depth of water, pile length, required pile penetration into the ocean floor, and the height of the jacket structure, pile followers may consist of a number of sections each one of which must be handled onto and off of each pile. These multiple handling steps are extremely time consuming and expensive.

An alternate approach to pile driving has been to dispose steam and air hammers underwater at the submerged locations on the top of the piles to drive the piles directly. Representative of this approach is the HYDROBLOK™ type HBM-3000 pile driver which is manufactured by Hollandsche Beton Mattschappij by. The HYDROBLOK™ system includes a casing having a pile sleeve provided at its lower end to center the hammer onto the pile. The ram and hydraulic power unit for the HYDROBLOK™ hammer are contained within the casing which is purged of water by air pressure supplied by an air line extending from the surface of the water. Ballast is provided on the sleeve to assist in holding the hammer down on the pile.

A possible disadvantage of the use of a large air filled casing is the buoyant force which is produced. The HYDROBLOK™ hammer is a differential hammer requiring a gravity reaction for the force acting on the ram during its downstroke. Any positive buoyancy created by the casing must be replaced by ballast which increases the dry handling weight of the hammer.

Another major problem encountered is that of initially placing this hammer in contact with a pile disposed in a deep body of water. The diameter of the hammer is several times the diameter of the pile to be driven and, therefore, the hammer cannot be merely dropped into alignment with the top of the pile on a conventional jacket structure. Accordingly, when using this hammer to date, followers are still employed, thus eliminating any time or cost savings which could be derived from utilizing a hammer capable of operating underwater.

Another hammer device that is disclosed as being suitable for operation totally submerged in water is the airgun repeater pile driver disclosed in U.S. Pat. No. 3,817,335 and assigned to Bolt Associates, Inc. Although the patent discloses details of a hammer device and characterizes it as a device capable of underwater operation to drive a pile, no teachings are provided of a suitable method for effective aligning and bringing the hammer into contact with a pile, especially a pile located in deep water.

Another approach to the driving of piles by a hammer device involves the disposition of a pile driving hammer within the leg of an offshore structure, which hammer engages the upper end of the pile to deliver driving blows thereto. The hammer is provided with a hollow case with the ram movable within a casing. The hammer and casing are raised and lowered within the leg by a flexible cable. This arrangement is disclosed in U.S. Pat. No. 3,604,522, issued to S. C. Doughty. A seeming disadvantage and hazard to the system proposed by Doughty is that the construction of the hammer, with its anvil being an integral part of the casing, appears to be likely to have the casing pulled into tension, whereby the casing will become broken or fractured.

Accordingly, a method of driving piles in great depths of water using an underwater pile-driving hammer which would substantially increase the effective hammer efficiency over current methods, reduce the size or eliminate the need of derrick barges required to support the pile driving operations, and reduce the time necessary to install deep water piling is highly desirable.

SUMMARY OF THE INVENTION

In accordance with the instant invention, there is provided a novel method of driving piles into the ocean floor by a succession of blows delivered directly to the top of a pile by a hammer disposed beneath the surface of the water. In a particular embodiment, the instant invention provides a method of driving piles into an ocean floor under a great depth of water to secure the support legs of an offshore structure to the bottom.

Piles driven in accordance with the method of this invention are disposed underwater in guide sleeves secured at spaced locations along the exterior of a member that extends down to the ocean floor. A housing containing a hammer is lowered through the sleeves and into contact with the pile, with the hammer being disposed beneath the surface of the water. The pile is then driven into the ocean floor by a succession of blows delivered by the hammer to the top of the pile.

Further in accordance with the present invention, the method includes lowering the housing through the guide sleeves as the pile is driven farther into the ocean floor, with subsequent raising of the housing after the pile is driven to the desired depth in the ocean floor and moving of the housing to the next pile driving location.

In another aspect of the present invention, upper and lower housings are utilized, with the lower housing containing a hammer. A method for driving a pile in accordance with this aspect of the invention involves placing the lower housing in at least the uppermost guide sleeve, pinning the lower housing with at least the upper portion thereof being held above the surface of the water, placing the upper housing upon the lower housing and coupling the two housings together, unpinning the lower housing and lowering the housings through the guide sleeves into contact with the pile, and delivering a succession of blows to the top of the pile to drive it into the ocean floor. The method may further include raising the housings, uncoupling the upper housing from the lower housing, and placing the lower housing in another driving position.

In another aspect of the present invention, placing of the lower housing in the uppermost guide sleeve and placing of the upper housing atop the lower housing for coupling is performed using a short sling hoist line arrangement depending from a crane. Further in accordance with this aspect of the invention, lowering of the combined housing assembly comprising the upper and lower housings is accomplished using a long sling hoist line arrangement depending from a crane.

It is among the features and advantages provided by the present invention that the need for multi-section pile followers is eliminated, thereby reducing the time that derrick barges are needed to support offshore platform foundation construction operations, or eliminating them entirely. In addition, a great savings in time needed to install deep water foundations is attained, since the time spent in assembling a jointed pile follower of sufficient length is obviated. The savings in time and money afforded by the present invention will be most substantial in operations being carried out in areas where construction work time is limited by weather conditions, such as for example in the North Sea.

Other aspects and features of this unique concept for driving piles in deep water utilizing an underwater hammer not outlined above will be covered in detail in the detailed description presented below.

BRIEF DESCRIPTION OF THE DRAWINGS

A more complete understanding and appreciation of the invention may be had by reference to the accompanying drawings, which illustrate the steps in preferred embodiment of the method for driving piles into the ocean floor of the present invention, in which like reference numerals designate identical or corresponding parts throughout the several views and wherein.

DESCRIPTION OF A PREFERRED EMBODIMENT OF THE INVENTION

Figure 1:
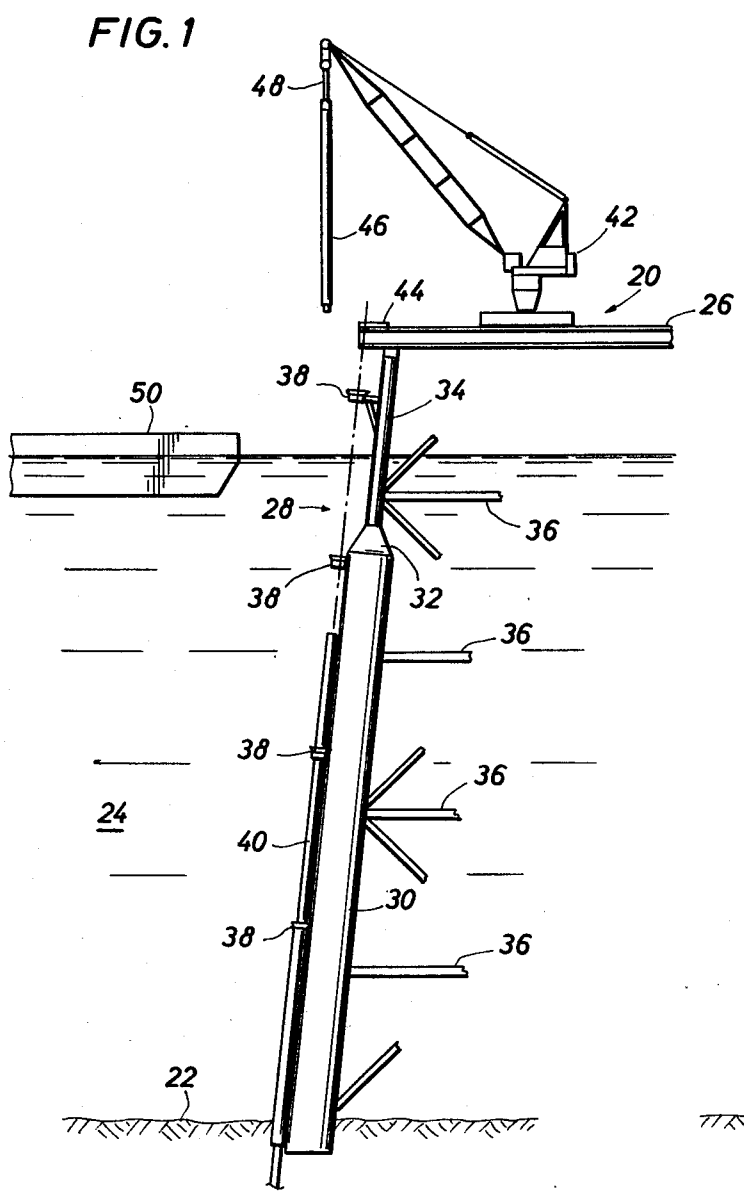
Figure 7:
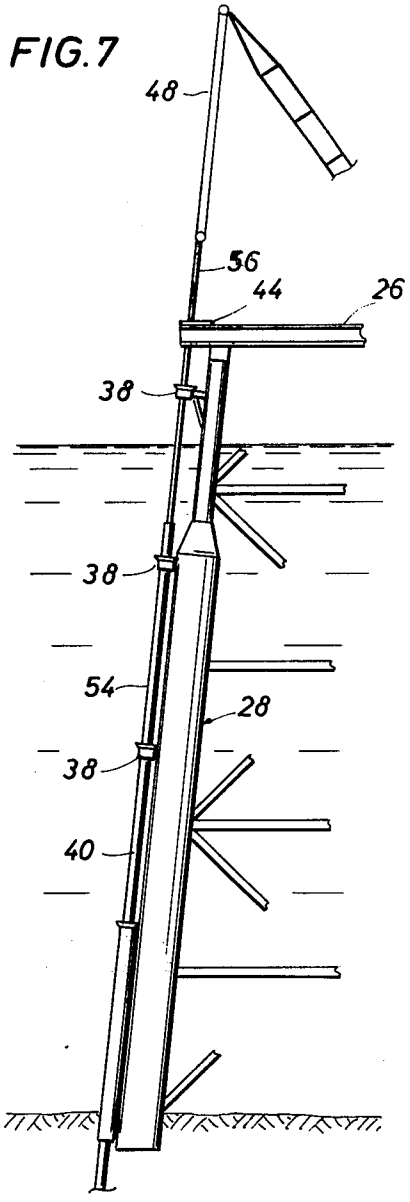
FIGS. 5–7 are corresponding views showing the lowering of the housings and the driving of the pile.
Figure 6:
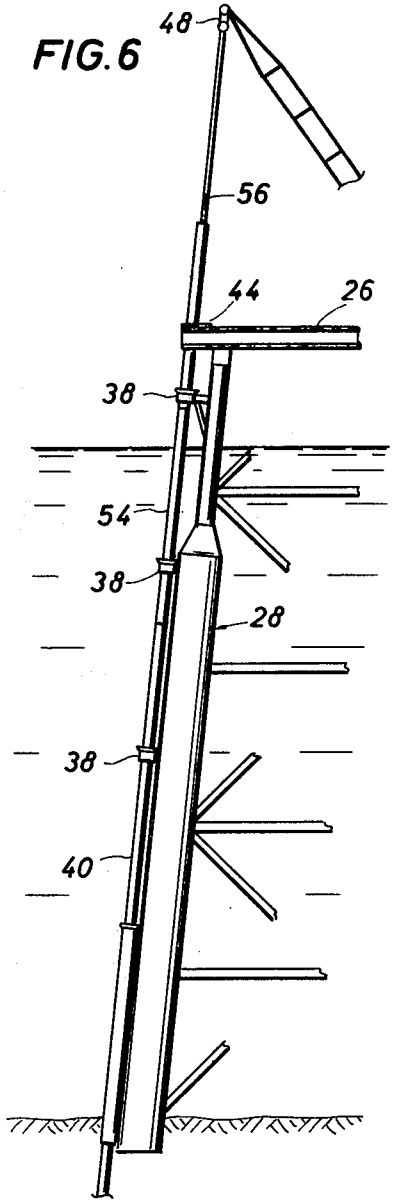

Referring now to FIG. 1, an offshore structure 20 is shown resting on the floor 22 of a body of water 24. The offshore structure may be of any suitable type known in the art adapted for carrying production or drilling equipment. For example, the offshore structure 20 may be of a fixed platform type or a jack-up platform.

Offshore structure 20 comprises a deck portion 26 supported atop a plurality of support members, of which only support member 28 is shown. Support member 28 is commonly referred to as the "platform leg" or the "jacket". The support member 28 or jacket comprises a lower cylindrical portion 30 that tapers through an intermediate portion 32 to connect with an upper portion 34. Cross-bracing structure 36 provides additional structural strength to the platform leg, which bracing comprises a plurality of structural members welded to the platform leg at various locations along the length of the leg.

Secured to the outside of support member 28 are a series of annular pile guide sleeves 38 disposed one above the other in a coaxially aligned relationship. A pile 40 that is to driven into the ocean floor 22 is disposed underwater in the lower most pile guide sleeves.

Mounted on the deck 26 of the offshore platform 20 is a crane 42 that is so mounted that the boom portion thereof may be lowered to overhang the edge of the deck 26. In addition, a work station 44 is provided in a portion of platform deck 26 that overhangs the upper portion 34 of support member 28. Although other pieces of equipment will, of course, be mounted on the deck 26 of the platform, only these two pieces of equipment are of interest in the discussion and description of the method pile driving to be disclosed herein.

With continued reference to FIG. 1, a lower housing 46 is shown suspended from the boom of crane 42 by a short sling cable arrangement 48. Crane 42 picks up the lower housing from the deck 26 of the platform, or in the alternative from the barge 50 shown positioned adjacent the offshore platform 20. The lower housing 46 contains therein a hammer device suitable for disposition underwater to deliver a succession of blows to a pile to urge the same into the ocean floor. One suitable hammer device is that disclosed in the copending U.S. patent application Ser. No. 743,327, of H. A. Nelson Holland and George J. Gendron. In that application, a pile driver for driving piles of various types and sizes into the earth is disclosed, which pile driver can be operated totally submerged in water. Although the hammer device disclosed in that application is preferred, any hammer suitable for use underwater may be utilized in the present method.

Figure 2:
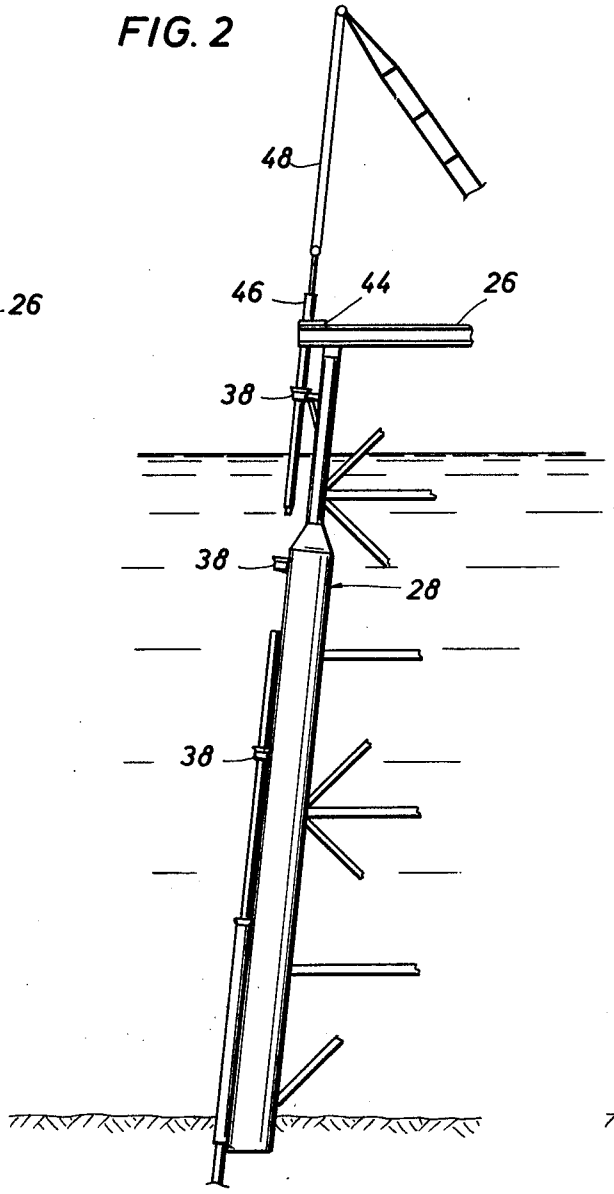
FIGS. 1 and 2 are elevation views of an offshore platform showing the disposition of a pile to be driven into the ocean floor and the step of placing the lower housing and hammer.

Referring next to FIG. 2, the lower housing 46 is shown being placed in the uppermost guide sleeve 38, and extending through work station 44. Work station 44 comprises a grouping mechanism (not shown) which can pin off or grip the lower housing and hold it in position in the work station.

Figure 3:
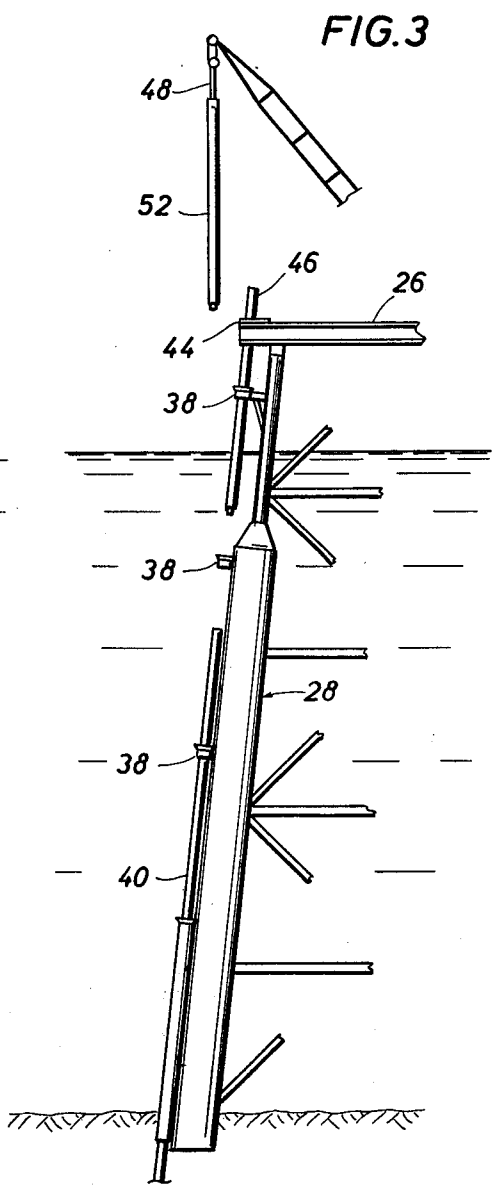
FIGS. 3 and 4 are similar elevation views of the platform showing the placing and coupling of the upper housing atop the lower housing.

The short sling cable 48 is released from lower housing 46, and as shown in FIG. 3 picks up upper housing 52.

Figure 4:
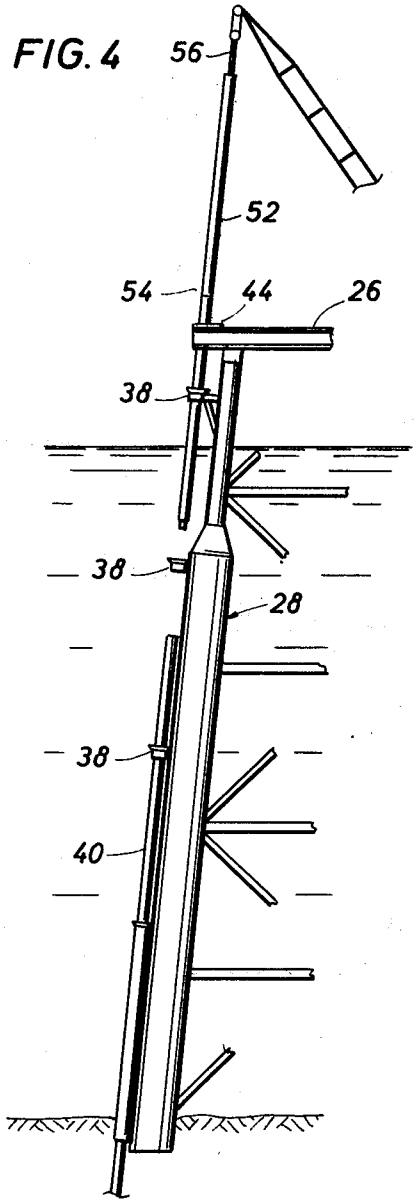

Referring to FIG. 4, upper housing 52 is placed atop lower housing 46, with the two housings being coupled together to form a single housing assembly 54. In addition, air lines (not shown) are at this point connected to the housing to supply the required air pressure needed for the hammer.

Figure 5:
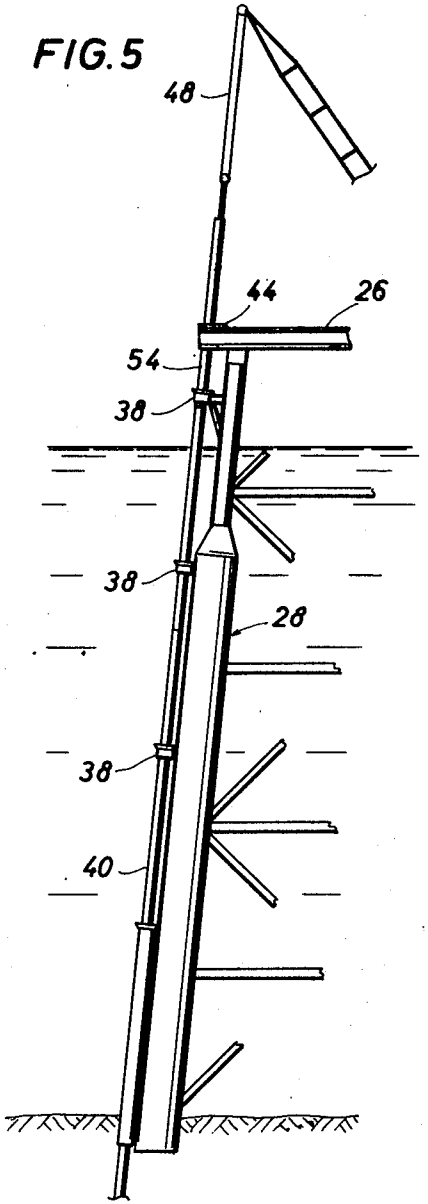

In FIG. 5, the lower housing 46 is unpinned, and the complete housing assembly 54 is lowered by the short sling 48 through the guide sleeves 38 into contact with pile 40. Pile 40 is driven into the ocean floor by a succession of blows delivered by the hammer contained within lower housing 46 until the top of upper housing 52 approaches the work station 44. At that point, depending on crane size, hammer and pile lengths, and offshore jacket configuration, it may be necessary to change from the short sling to a long sling arrangement 56. The payout hoist line of long sling arrangement 56 is slackened to permit lowering of the housing assembly 54 as driving of the pile continues.

It is important to note that the arrangement of the guide sleeves 38 must be such that the spacing between adjacent pairs of guide sleeves is not greater than one half the length of the complete housing assembly. In the preferred embodiment shown, the complete housing assembly 54, comprising upper housing 52 and lower housing 46 is approximately 200 feet in length. The spacing between adjacent pairs of guide sleeves 38 would be on the order of 100 feet. Therefore, it will be appreciated that in order to effect alignment of the housing assembly 54 containing the hammer device with the pile 40 to be driven that the housing assembly must span three guide sleeves.

Figure 8:
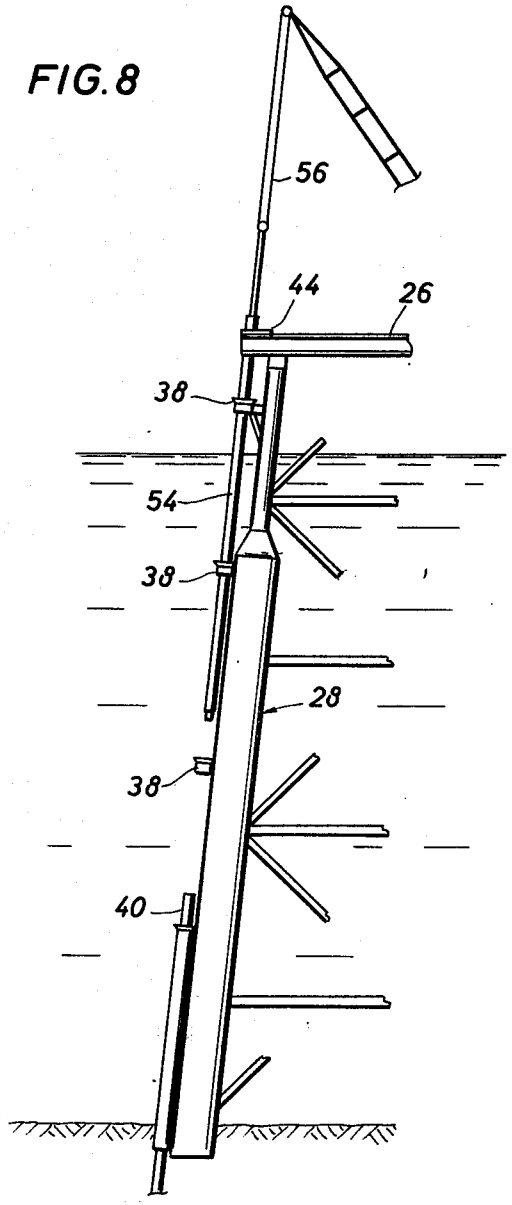
Figure 13:
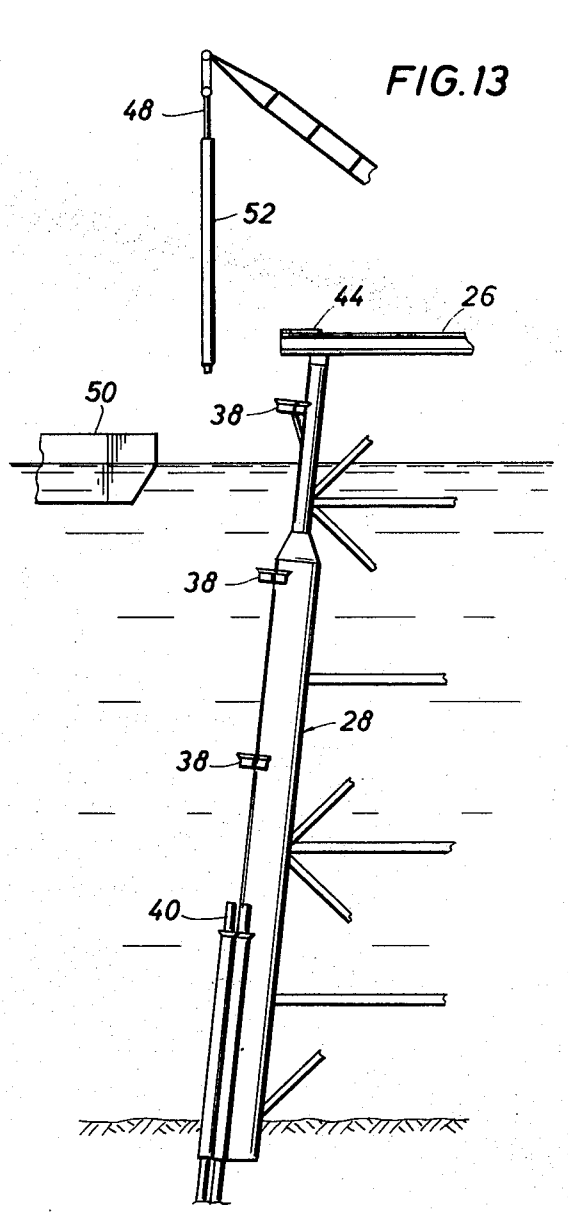
FIGS. 12–13 are views showing the dismantling and storing of the housings and hammer pending relocation of the work deck to another platform leg.
Figure 12:
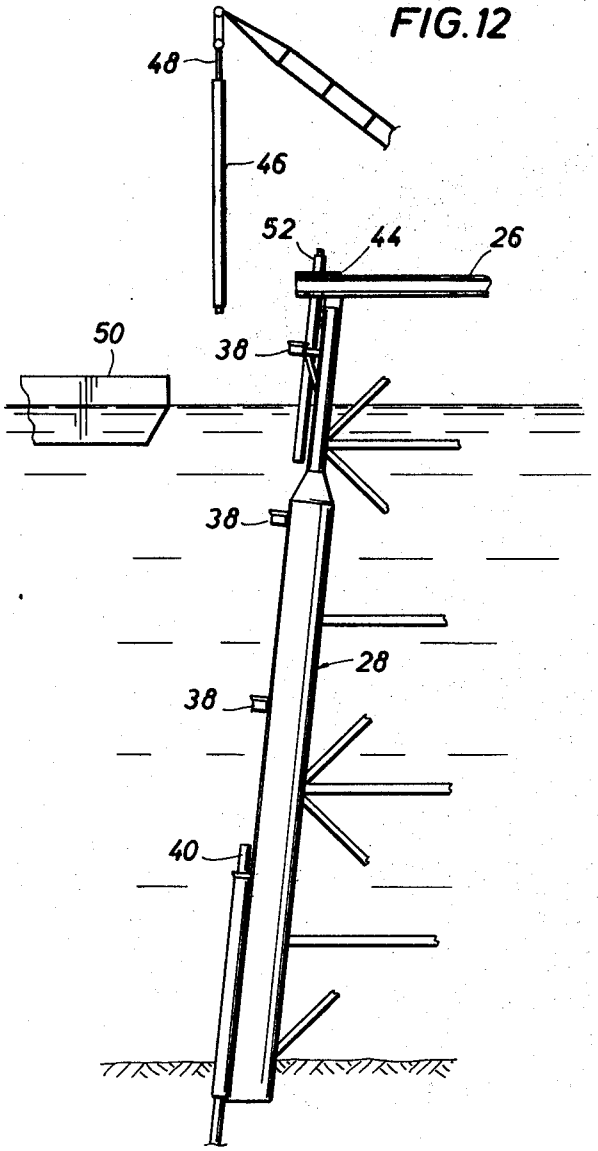

At the conclusion of driving, as when the pile 40 is driven to the depth within ocean floor 22 that is desired, the housing assembly 54 is raised through the guide sleeves 38 as shown in FIG. 8. The housing assembly 54 is raised until the top of upper housing 52 extends just above the deck level of work station 44, whereupon the complete assembly is pinned off to hold it in position. The air supply lines are disconnected, and, if necessary, the long sling 56 is changed to the short sling 48.

Figure 9:
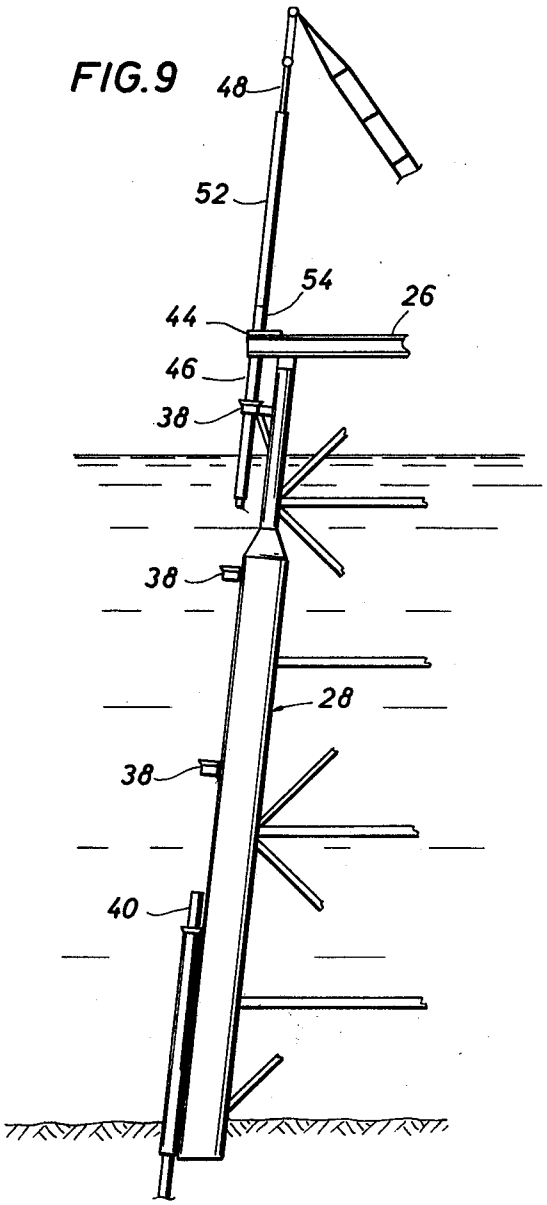

As shown in FIG. 9, the housing assembly 54 is further raised until the upper end of lower housing 46 extends just above the deck level of work station 44. Lower housing 46 is then pinned to hold it in position and the upper housing 52 is uncoupled from lower housing 46.

Figure 10:
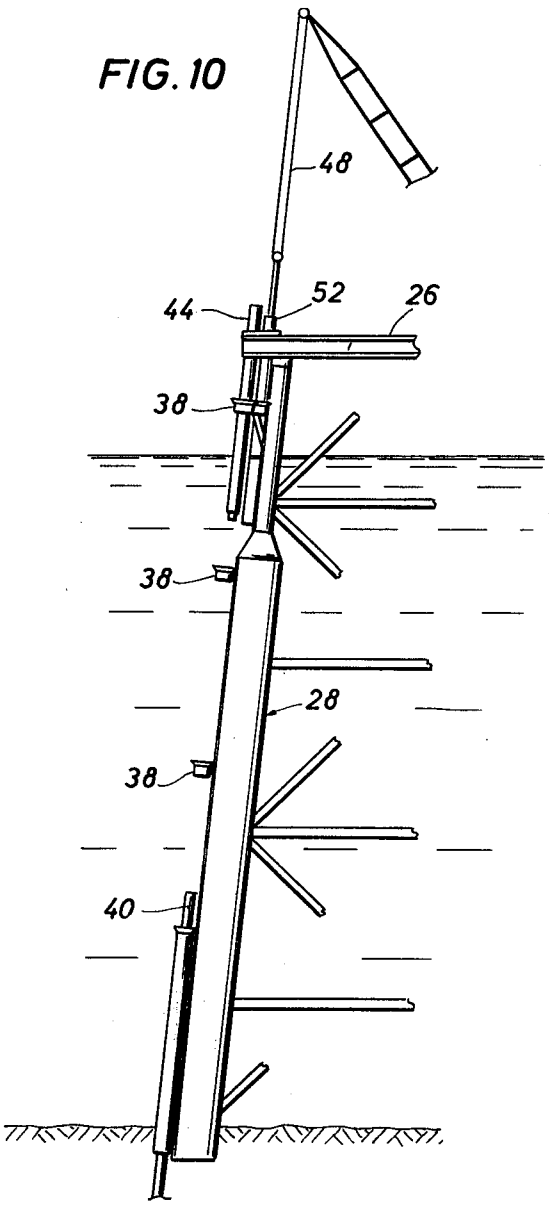
FIGS. 8–10 are views showing the raising and uncoupling of the housings.
Figure 11:
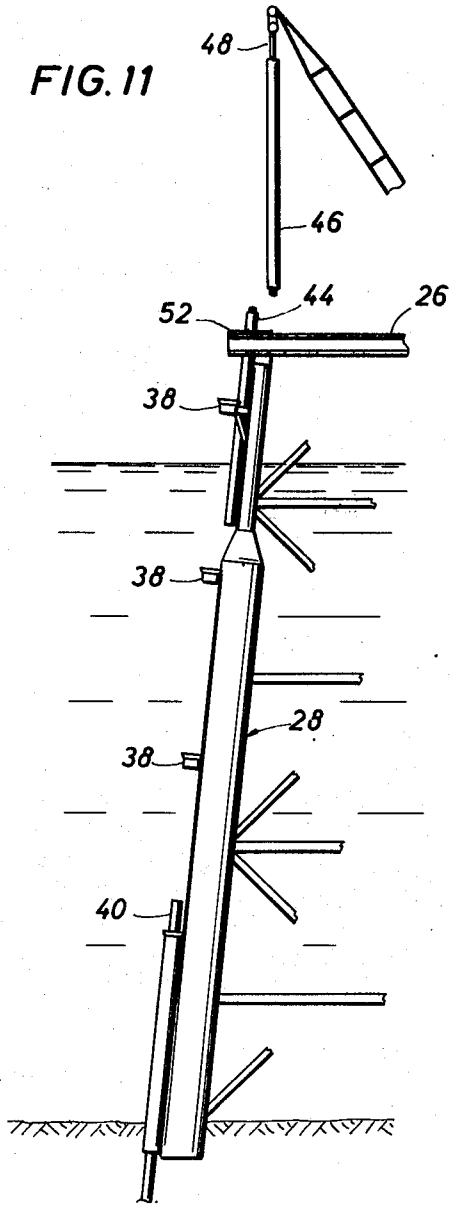
FIG. 11 is a view showing the placing of the lower housing and hammer in the next pile driving position.

Referring next to FIG. 10, the upper housing 52 is temporarily stored in another set of pile guides. Sling 48 is again connected to lower housing 46, which is then removed from work station 44 and guide sleeve 38, and moved to the next driving position as shown in FIG. 11.

Typically, more than one pile will be provided for each leg. For example, in a deep water structure operating in 300 to 400 feet of water, at least four piles would be required at each leg. Therefore, the procedure outlined above would proceed again with the positioning of the lower housing at the next driving position. At the conclusion of driving all piles, the upper housing and the lower housing having the hammer are stored on work barge 50. The work station 44 is then relocated to the next platform leg, whereupon the entire procedure is again initiated to drive the piles associated with the next leg.

The advantages attributable to this invention arise from the concept of placing an underwater hammer in a housing which is lowered beneath the surface of the water into contact with the top of a pile that is desired to be driven into the ocean floor. This unique concept provides ease of alignment of the driving hammer and pile without impairing the efficiency of the pile driving system, or making the amount of time required to perform a pile driving operation extremely lengthy. The concept is applicable not only to the presently disclosed situation of driving piles to secure the legs of an offshore platform to the ocean floor, but others, such as, for example, the placement of support piles in the floor of a body of water wherein the top of a pile is to be disposed underwater.

Although the foregoing description of a preferred embodiment of the invention has been with regard to a housing assembly comprising upper and lower housing sections, the invention also contemplates the use of only a single housing section having a hammer contained therein. In practicing this invention in the context of a single section housing, positioning of the housing in contact with the top of a pile, where the pile sleeves must present a minimum of surface area upon which waves and currents can act in order to reduce forces acting on the structure, requires that proper spacing between the pile guide sleeves be maintained. As pointed out previously, acceptable spacing should be no greater than the one half the length of the housing being used with such an arrangement, the housing and hammer may be readily brought into alingment with the top of the pile.

The foregoing description of the invention has been directed to a particular preferred embodiment thereof for purposes of explanation and illustration. It will be apparent, however, to those skilled in this art that many modifications and changes in the disclosed method may be made without departing from the scope and spirit of the invention. It is therefore intended that the following claims cover all equivalent modifications and variations as fall within the scope of the invention as defined by the claims.

What is claimed is:

1. In a method for securing an offshore structure to an ocean floor by driving a plurality of elongated piles into the ocean floor, said structure having a plurality of legs with a plurality of annular guide sleeves spaced along the legs for guiding the piles to the ocean floor and for supporting the piles while they are driven into the ocean floor, the improvement comprising:

lowering a housing, having a hammer mounted therein, and which has substantially the same diameter as the diameter of the pile to be driven, through said annular guide sleeves into contact with the pile; and delivering a succession of blows to said pile with said hammer to drive said pile into the ocean floor.

2. The method of claim 1 including the step of:

lowering said housing as said pile is driven into the ocean floor.

3. The method of claim 1 including the steps of:

raising said housing through said guide sleeves after said pile has been driven to a desired depth within the ocean floor; and moving said housing to another driving location.

4. The method of claim 1 wherein the step of lowering said housing into contact with the pile is performed by an overhead hoist having a sling arrangement connecting to the upper end of the housing.

5. A method of driving a pile into the ocean floor, comprising the steps of:

positioning an elongate member having guide sleeves affixed at a plurality of spaced apart locations along the exterior of said member in a body of water with the lower end thereof extending down to the ocean floor;

disposing a pile underwater in said guide sleeves;

placing a lower housing having a hammer mounted inside in at least the uppermost one of said guide sleeves at a driving location;

coupling an upper housing to said lower housing to form a housing assembly;

lowering said housing assembly through said guide sleeves and into contact with said pile, said hammer being beneath the surface of the water; and delivering a succession of blows to said pile with said hammer to drive said pile into the ocean floor.

6. The method of claim 5 including the steps of:

raising said housing assembly through said guide sleeves to a location proximate the top of said member, after said pile has been driven to a desired depth within the ocean floor;

uncoupling said upper housing from said lower housing; and moving said lower housing to another driving location.

7. The method of claim 5 wherein placing of said lower housing is by a hoist having a short sling that connects to the upper end of said lower housing, and lowering of said housing assembly is by a hoist having a long sling that connects to the upper end of said upper housing.

8. The method of claim 5 wherein said guide sleeves are affixed at locations that are separated by a distance that is no greater than one half the length of said housing assembly.

9. The method of driving a pile into the ocean floor, comprising the steps of:

positioning an elongate member having annular guide sleeves affixed at several spaced apart locations along the exterior of said member in a body of water in a substantially vertical attitude, with the upper end extending above the surface of the water and the lower end extending down to the ocean floor;

disposing a pile underwater in said guide sleeves proximate the lower end of said elongate member;

picking up a lower housing having a hammer mounted inside from a storage area using a short sling hoist line;

placing said lower housing in a work deck at a driving location and in at least the uppermost one of said guide sleeves and pinning said lower housing in position;

picking up an upper housing using said short sling hoist line;

coupling said upper and lower housings together end-to-end to form a housing assembly;

unpinning said lower housing and lowering said housing assembly through said guide sleeves and into contact with said pile, said hammer being beneath the surface of the water; and driving said pile with said hammer.

10. The method of claim 9, further comprising the steps of:

lowering said housing assembly while driving said pile until the upper end said upper housing approaches the level of the work deck;

changing from said short sling hoist line to a long sling hoist line; and driving said pile farther into the ocean floor, with said housing assembly being lowered as driving continues.

11. The method of claim 10, further comprising the steps of:

raising said housing assembly through said guide sleeves, after said pile has been driven to a desired depth within the ocean floor, until the upper end of said upper housing is at the level of the work deck;

pinning said upper housing and changing from the long sling hoist line to the short sling hoist line;

resuming raising of said housing assembly until the upper end of said lower housing is at the level of the work deck, whereupon said lower housing is pinned in position;

uncoupling said upper housing from said lower housing and storing said upper housing; and picking up said lower housing with the short sling hoist line and placing it in another driving position.

* * * * *